US007102298B2

(12) United States Patent
Nerone et al.

(10) Patent No.: US 7,102,298 B2
(45) Date of Patent: Sep. 5, 2006

(54) INTEGRAL LAMP

(75) Inventors: Louis R. Nerone, Brecksville, OH (US); David J. Kachmarik, Strongsville, OH (US); Joseph C. Oberle, Chagrin Falls, OH (US); Michael S. Idelchik, Mequon, WI (US)

(73) Assignee: General Electric Company, Schenectady, NY (US)

( * ) Notice: Subject to any disclaimer, the term of this patent is extended or adjusted under 35 U.S.C. 154(b) by 302 days.

(21) Appl. No.: 10/212,358

(22) Filed: Aug. 5, 2002

(65) Prior Publication Data

US 2003/0006718 A1 Jan. 9, 2003

Related U.S. Application Data

(62) Division of application No. 09/637,768, filed on Aug. 11, 2000, now Pat. No. 6,459,215.

(51) Int. Cl.
*G05G 1/00* (2006.01)

(52) U.S. Cl. ..... 315/291; 315/58; 315/209 R

(58) Field of Classification Search ..... 315/291, 315/58, 209 R, 62, 224, 239, 256, 307, 312, 315/493; 362/216
See application file for complete search history.

(56) References Cited

U.S. PATENT DOCUMENTS

| | | | | |
|---|---|---|---|---|
| 2,295,657 | A | 9/1942 | Hodgkins | 315/47 |
| 2,351,305 | A | 6/1944 | Thayer | 315/56 |
| 3,549,941 | A | 12/1970 | Friedman | 315/58 |
| 3,753,071 | A | 8/1973 | Engel et al. | 363/37 |
| 3,996,493 | A | 12/1976 | Davenport et al. | 315/58 |
| 4,042,819 | A | 8/1977 | Dacal | 315/189 |
| 4,092,562 | A | 5/1978 | Campbell | 363/101 |
| 4,109,307 | A | 8/1978 | Knoll | 315/58 |
| 4,204,139 | A | 5/1980 | Shimer et al. | 315/219 |
| 4,259,614 | A | 3/1981 | Kohler | 315/179 |
| 4,268,780 | A | 5/1981 | Roche et al. | 315/179 |
| 4,293,799 | A | 10/1981 | Roberts | 315/256 |
| 4,316,121 | A | 2/1982 | Hammer et al. | 315/62 |
| 4,353,007 | A | 10/1982 | Moerkens et al. | 315/62 |
| 4,508,996 | A | 4/1985 | Clegg et al. | 315/224 |
| 4,571,526 | A | 2/1986 | Wesselink | 315/56 |
| 4,740,873 | A | 4/1988 | Blake | 315/216 |
| 4,751,435 | A | 6/1988 | Roche et al. | 315/235 |
| 4,792,726 | A | 12/1988 | Gandhi | 315/52 |
| 4,857,806 | A | 8/1989 | Nilssen | 315/72 |
| 4,939,420 | A | 7/1990 | Lim | 315/58 |

(Continued)

FOREIGN PATENT DOCUMENTS

DE 195 12 307 A1 10/1996

(Continued)

*Primary Examiner*—Tuyet Vo
*Assistant Examiner*—Jimmy Vu
(74) *Attorney, Agent, or Firm*—Fay, Sharpe, Fagan, Minnich & McKee, LLP

(57) ABSTRACT

An integrated lamp/lamp electronics unit includes a lamp having a first end with first end electrical terminals, and a second end with second end electrical terminals. An end cap having an interior section is placed into electrical connection with the first end electrical terminals at the first end of the lamp. Lamp electronics are configured to control operation of the lamp and are connected only to the second end electrical terminals. The lamp electronics are carried on a circuit board having a configuration substantially matching the second end of the lamp portion. The circuit board is placed within the interior of a lamp electronics end cap, and the end cap is attached in a permanent relationship to the second end of the lamp.

10 Claims, 6 Drawing Sheets

U.S. PATENT DOCUMENTS

| | | | | | |
|---|---|---|---|---|---|
| 5,047,696 | A | | 9/1991 | Nilssen | 315/312 |
| 5,189,339 | A | | 2/1993 | Peshak | 315/58 |
| 5,208,511 | A | | 5/1993 | Garbowicz | 315/106 |
| 5,294,865 | A | | 3/1994 | Haraden | 315/58 |
| 5,331,253 | A | | 7/1994 | Counts | 315/209 R |
| 5,485,057 | A | | 1/1996 | Smallwood et al. | 315/58 |
| 5,578,905 | A | * | 11/1996 | Graber | 315/76 |
| 5,654,609 | A | | 8/1997 | Smallwood et al. | 315/56 |
| 5,710,487 | A | | 1/1998 | Valcke | 315/205 |
| 5,712,526 | A | | 1/1998 | Fulop et al. | 313/493 |
| 5,720,546 | A | | 2/1998 | Correll, Jr. et al. | 362/221 |
| 5,907,218 | A | | 5/1999 | Altman et al. | 315/56 |
| 6,018,220 | A | | 1/2000 | Nerone | 315/219 |
| 6,078,143 | A | | 6/2000 | Nerone | 315/209 R |
| 6,459,215 | B1 | * | 10/2002 | Nerone et al. | 315/291 |
| 6,555,974 | B1 | * | 4/2003 | Cline et al. | 315/312 |
| 2002/0111070 | A1 | * | 8/2002 | Nerone et al. | 439/612 |
| 2004/0160199 | A1 | * | 8/2004 | Morgan et al. | 315/312 |

FOREIGN PATENT DOCUMENTS

| | | | |
|---|---|---|---|
| DE | 100 38 218 | A1 | 1/2002 |
| EP | 0 274 107 | A | 7/1988 |
| GB | 1 401 628 | | 7/1975 |
| WO | WO 91/16802 | | 10/1991 |
| WO | WO 96/31996 | | 10/1996 |
| WO | WO 00 41495 | A | 7/2000 |
| WO | WO 00 21342 | A | 4/2002 |

* cited by examiner

INTEGRAL LAMP

This application is a divisional of U.S. application Ser. No. 09/637,768 filed on Aug. 11, 2000, which is now U.S. Pat. No. 6,459,215.

BACKGROUND OF THE INVENTION

The present invention is directed to an electronic lamp, and to the connection between a lamp and lamp electronics which control operation of the lamp.

Lamp systems including a lamp and electronics, supplied by a power source are known in the art. A problem with known lamp systems is that existing connection schemes between the power source, lamp and electronics, do not allow for the electronics to be an integral part of the lamp. Rather, the electronics are commonly set apart from the lamp within the system housing or fixture.

Attempts have been made to closely attach the lamp and the electronics. An example of such a system is described in two patents to Smallwood et al., U.S. Pat. Nos. 5,485,057 and 5,654,609. The Smallwood et al. patents set forth two embodiments of a gas discharge lamp system. The first embodiment is directed to high frequency systems. In this situation a.c. power conditioning may be designed as a master controller. Then a separate miniaturized high-frequency oscillator and transformer is formed as a module and attached to the end of the lamp. In low-frequency embodiments, Smallwood et al. describes placing a power oscillator circuit within a gas discharge lamp envelope, eliminating components which are presently mounted external to the lamp. However, in Smallwood et al. conductor wires extend the length of the lamp envelope to a second heater element to connect the second heater element to the oscillator module. These conductor wires are noted as being preferably positioned along the inner surface of the envelope to minimize damage in handling.

German Patent DE 195 12 307 A1 to Reinig, discloses some sort of electronics being located on a single end of a lighting tube. However, in Reinig it is also necessary to provide a conductor wire along the length of the lamp to complete the electrical connection. Thus, in both the Smallwood et al. patents and the Reinig patent, a wiring connection is provided directly from the electronics controlling operation of the lamp to the opposite end of the lamp.

A problem with having exterior wires running the length of the lamp is the likelihood of such connections becoming dislodged or otherwise broken. This design will also interfere or block portions of light output from the lamp. An alternative suggested in Smallwood et el. is to run the conductor along the inner surface of the envelope. However, Smallwood et al. does not describe how this is to be accomplished. Running a conductor within the envelope increases the manufacturing complexity and adds costs to the system. Further, a lamp having a conductor within the lamp envelope is subject to a hostile environment which may act to accelerate the deterioration of the lamp.

It is therefore considered beneficial to design a lamp system where the lamp electronics are positioned on an end of the lamp in an integral relationship with the lamp, whereby the integral lamp/lamp electronics unit may be removed as a single component from the housing of the system. It would also be desirable for the integral lamp/lamp electronics unit to be supplied by the power source without requiring a conductor wire to be positioned along the length of the lamp, on the interior of the glass envelope of the lamp or attached to the exterior of the glass envelope of the lamp.

SUMMARY OF THE INVENTION

An integrated lamp/lamp electronics unit includes a lamp having a first end with first end electrical terminals, and a second end with second end electrical terminals. An end cap having an interior section is placed into electrical connection with the first end electrical terminals at the first end of the lamp. Lamp electronics are configured to control operation of the lamp and are connected only to the second end electrical terminals. The lamp electronics have a configuration substantially matching the second end of the lamp portion. The electronic circuit is placed within the interior of a lamp electronics end cap, and the end cap is attached in a permanent relationship to the second end of the lamp.

DETAILED DESCRIPTION OF THE PREFERRED EMBODIMENTS

Figure 1:
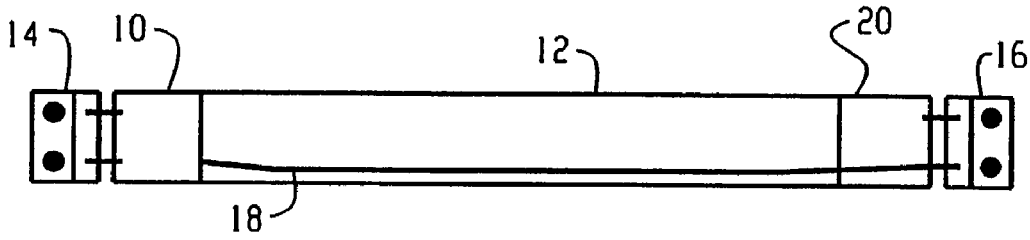
Fig. 1 PRIOR ART
FIG. 1 sets forth a prior art connection scheme for a linear lamp.

Illustrated in FIG. 1 is a prior art attempt at implementing lamp electronics 10 on an end of a lamp 12. In this embodiment lamp 12 may be a linear fluorescent lamp generally known in the art, and lamp electronics 10 may be of an electronic type ballast. End connectors 14 and 16 may be any of many known end connectors including tombstone connectors. For convenience, the power source and external wiring connections usually provided for operating a lamp system are not illustrated in this drawing.

In FIG. 1, lamp electronics 10 are placed in close association with lamp 12. However, to complete the circuit path for operation—when the power source and external wiring are attached—it is necessary to run a conductor wire 18 from lamp electronics 10 along the length of lamp 12 to the opposite end 20 of lamp 12.

Figure 2:
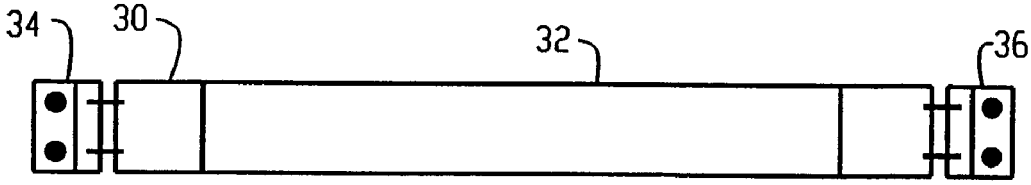
FIG. 2 illustrates a lamp/lamp electronics unit according to the teaching of the present invention.

Turning to FIG. 2, shown is a diagram of one embodiment of the present invention. In this design lamp electronics 30 are integrated with lamp 32. Lamp electronics 30 are connected at one end to an end connector 34, and lamp 32 is connected to a second end connector 36. For convenience, and similar to FIG. 1, the power source and external wiring are not shown in FIG. 2.

In FIG. 2, no external or internal conductor wire extends along the length of lamp 32 from the integrated end of lamp electronics 30 and lamp 32 to the opposite end of lamp 32. Rather, and as will be explained in more detail below, the wiring connection within the lamp housing connects to end connector 36 in such a manner that a complete electrical path is provided to operate the lamp 32/lamp electronics 30 configuration. Thus, by use of the design in FIG. 2 a user may easily remove lamp electronics 30 and lamp 32 as a single unit thereby increasing the ease with which no longer functioning units may be replaced.

Figure 3:
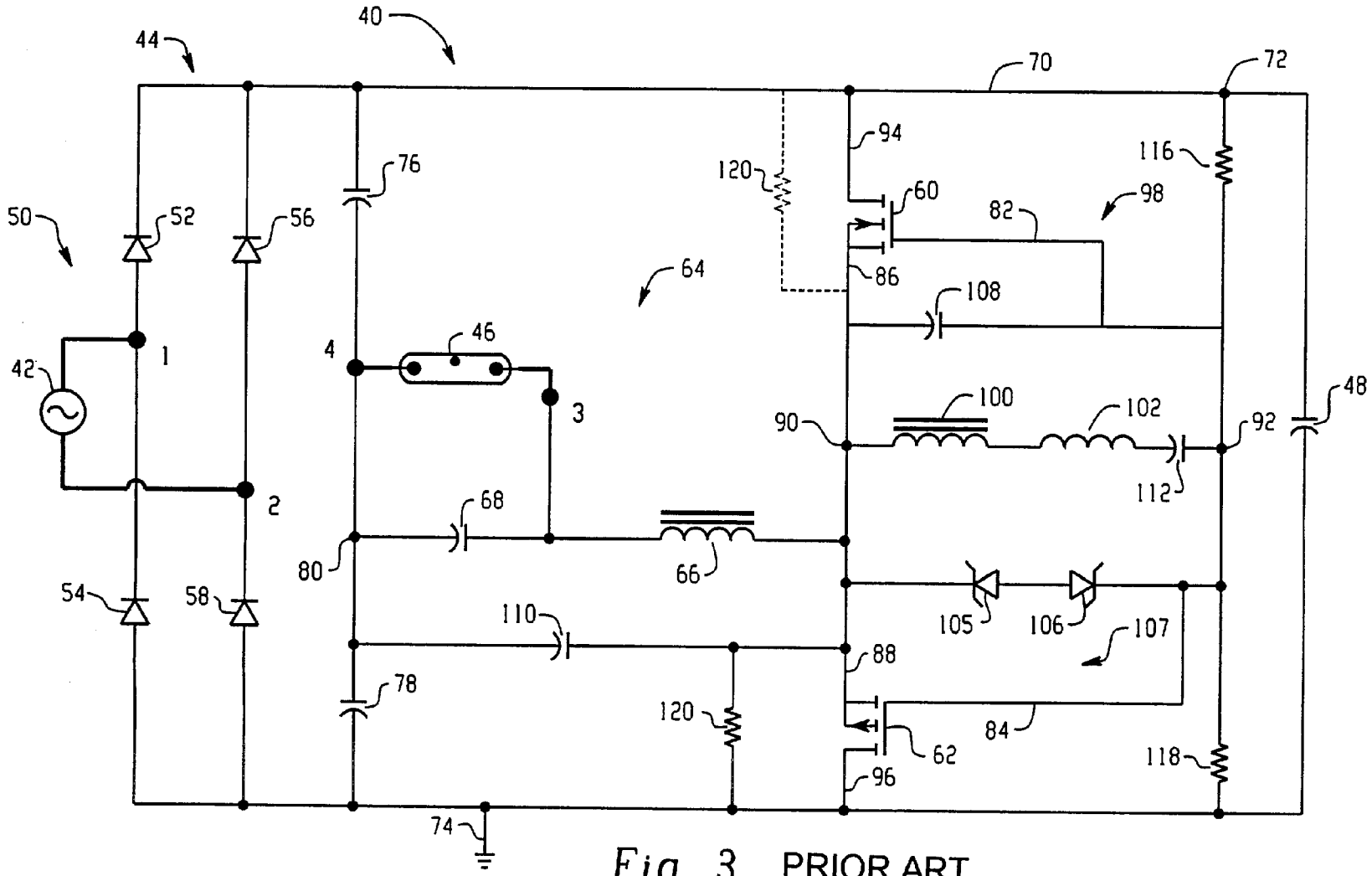
Fig. 3 PRIOR ART
FIG. 3 depicts a fluorescent lamp system including a power source, an electronic circuit and linear fluorescent lamp.

Turning to FIG. 3, illustrated is a gas discharge lamp system 40 supplied by power source 42 which supplies power to lamp electronics 44, which in turn controls operation of a gas discharge lamp, such as a linear fluorescent lamp 46. In this FIG., lamp electronics 44 are shown in a non-integrated design with lamp 46. Once operation of the circuit in FIG. 3 has been described, attention will then be directed to FIG. 6 which illustrates a circuit and connections that permit integration of lamp electronics and a lamp into a single integrated unit.

In FIG. 3 lamp electronics 44 include a non-electrolytic smoothing capacitor 48, described in U.S. Pat. No. 6,018,220, to Nerone. Power source 42, which may be an a.c. source, supplies current to an a.c.-to-d.c. rectifier, which may be a full-wave bridge rectifier 50, formed by diodes 52, 54, 56, 58. An electromagnetic interference (emi) filter (not shown) suppresses conducted emissions produced by a high frequency inverter. Switches 60 and 62 are respectively controlled to convert d.c. current from rectifier 50 to a.c. current received by resonant load circuit 64, including resonant inductor 66 and resonant capacitor 68. D.c. bus voltage 70, exists between bus conductor 72 and reference conductor 74, shown for convenience as a ground. Resonant load circuit 64 also includes lamp 46, which, as shown, may be shunted across resonant capacitor 68. Capacitors 76 and 78 are standard "bridge" capacitors for maintaining their commonly connected node 80 at about ½ bus voltage.

In circuit 44, switches 60 and 62 are complementary to each other in the sense, for instance, that switch 60 may be an n-channel enhancement mode device as shown, and switch 62 a p-channel enhancement mode device as shown. These are known forms of MOSFET switches, but Bipolar Junction Transistor switches could also be used, for instance. Each switch 60 and 62 has a respective gate, or control terminal 82, 84. The voltage from gate 82 to source 86 of switch 60 controls the conduction state of that switch. Similarly, the voltage from gate 84 to source 88 of switch 62 controls the conduction state of that switch. As shown, sources 86 and 88 are connected together at a common node 90. With gates 82 and 84 interconnected at a common control node 92, the single voltage between control node 92 and common node 90 controls the conduction states of both switches 60 and 62. The drains 94 and 96 of the switches are connected to bus conductor 72 and reference conductor 74, respectively.

Gate drive circuit 98, connected between control node 92 and common node 90, controls the conduction states of switches 60 and 62. Gate drive circuit 98 includes a driving inductor 100 that is mutually coupled to resonant inductor 66 and is connected at one end to common node 90. The other end of inductor 66 may be a tap from transformer winding inductors 100 and 66. Driving inductor 100 provides the driving energy for operation of gate drive circuit 98. A second inductor 102 is serially connected to driving inductor 100. As will be further explained below, second inductor 102 is used to adjust the phase angle of the gate-to-source voltage appearing between nodes 90 and 92. A pair of diodes 105, 106 configured as a bi-directional voltage clamp 107 between nodes 90 and 92 clamps positive and negative excursions of gate-to-source voltage to respective limits determined, e.g., by the voltage ratings of the back-to-back Zener diodes shown. A capacitor 108 is preferably provided between nodes 90 and 92 to predictably limit the rate of change of gate-to-source voltage between nodes 90 and 92. This beneficially assures, for instance, a dead time interval in the switching modes of switches 60 and 62 wherein both switches are off between the times of either switch being turned on.

Beneficially, the use of gate drive circuit 98 of FIG. 3 results in the phase angle between the fundamental frequency component of the resonant voltage between node 80 and node 90 and the current in resonant load circuit 64 to be approaching 0° during ignition of the lamp. Angular frequency $\omega_R$ is the frequency of resonance of resonant load circuit 64. At resonance, lamp voltage is at its highest value. It is desirable for the lamp voltage to approach such resonant point during lamp ignition. This is because the very high voltage spike generated across the lamp at such point reliably initiates an are discharge in the lamp, causing it to start. In contrast, during steady state operation, the lamp operates at a considerably lower voltage, at a higher angular frequency $\omega_{SS}$. Now referring to the phase angle between the fundamental frequency component of resonant voltage between nodes 90 and 80 and the current in resonant load circuit 64, this phase angle tends to migrate towards 0° during lamp ignition. In turn, lamp voltage migrates towards the high resonant voltage, which is desirable, as explained, for reliably starting the lamp.

With continuing attention to FIG. 3, the starting circuit may also include an optional snubber capacitor 110. Further provided is a coupling capacitor 112, connected between node 90 and inductor 102, that becomes initially charged, upon energizing of rectifier 50, via resistors 116, 118 and 120. At this instant, the voltage across capacitor 112 is zero, and during the starting process, serial-connected inductors 100 and 102 act essentially as a short circuit, due to the relatively long time constant for charging capacitor 112. With resistors 116, 118, 120 being of equal value, for instance, the voltage on node 90, upon initial bus energizing, is approximately ⅓ of bus voltage 70, while the voltage at node 92, between resistors 116 and 118 is ½ of bus voltage 70. In this manner, capacitor 112 becomes increasingly charged, from left to right, until it reaches the threshold voltage of the gate-to-source voltage of upper switch (e.g., 2–3 volts) 60. At this point, upper switch 60, switches into its conduction mode, which then results in current being supplied by switch 60 to resonant load circuit 64. In turn, the resulting current in the resonant load circuit causes regenerative control of first and second switches 60 and 62 in the manner previously described.

During steady state operation of lamp electronics 44, the voltage of common node 90, between switches 60 and 62, becomes approximately ½ of bus voltage 70. The voltage at node 92 also becomes approximately ½ bus voltage 70, so that capacitor 112 cannot again, during steady state operation, become charged so as to again create a starting pulse for turning on switch 60. During steady state operation, the capacitive reactance of capacitor 112 is much smaller than the inductive reactance of driving inductor 100 and inductor 102, so that capacitor 112 does not interfere with operation of those inductors.

Resistor 120 may be alternatively placed as shown in broken lines, for shunting upper switch 60, rather than lower switch 62. The operation of the circuit is similar to that described above with respect to resistor 120 shunting lower switch 62. However, initially, common node 90 assumes a higher potential than node 92 between resistors 116 and 118, so that capacitor 112 becomes charged from right to left. The results in an increasingly negative voltage between node 92 and node 90, which is effective for turning on lower switch 62.

Resistors 116 and 118 are both preferably used in the circuit of FIG. 3; however, the circuit will function substantially as intended with resistor 118 removed and using resistor 120 as shown in solid lines. The use of both resistors 116 and 118 may result in a quicker start at a somewhat lower line voltage. The circuit will also function substantially as intended with resistor 116 removed and using resistor 120 as shown in dashed lines. Additionally resistors 116,118 and 120 are non-critical value components, which may be 100 k ohms or 1 megohm each, for example. Preferably such resistors have similar values, e.g., approximately equal.

Figure 4:
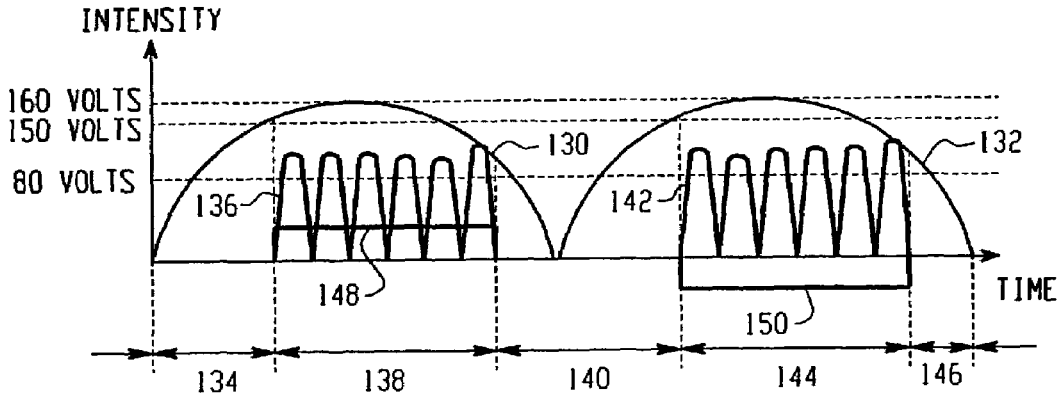
FIGS. 4 and 5 show various circuit wave forms.

FIG. 4 depicts various circuit waveforms as produced by a prior art circuit which does not employ capacitor 48. This may be compared with FIG. 5 which represents circuit waveforms generated by the circuit of FIG. 3 which employs the non-electrolytic capacitor 48. This comparison emphasizes the more continuous a.c. current drawn from the circuit of FIG. 3.

In FIG. 4 waveforms 130 and 132 are consecutive half cycles of rectified voltage. Waveform 130 is the rectified ac voltage applied to node 70, and waveform 132 is the high frequency current through switch 60. A typical prior art circuit employs a voltage-breakover device, such as a diac for starting regenerative operation of gate control circuitry for the converter switches. Such devices typically have a voltage-breakover threshold requiring, for instance, 150 volts of bus voltage to fire. Thus, only after expiration of time interval 134 of FIG. 4 does prior art ballast circuit start operation, indicated by voltage curve 136. The prior art circuit stops operation after expiration of time period 138 when voltage waveform 130 drops to, e.g., 80 volts, and does not restart until voltage waveform 132 reaches, e.g., 150 volts, after expiration of time period 140. The circuit oscillates as indicated by voltage curve 142 until the end of time interval 144, and is off during subsequent time interval 146. The offset in averaged a.c. current 148 and 150 to the right of center of their respective half cycles significantly contributes to a low power factor, arising from frequency components of the a.c. input current being out of phase with the a.c. input voltage.

While the lamp electronic circuit oscillates, averaged a.c. current 148 is drawn during half-cycle 130, and averaged negative a.c. current 150 is drawn during half-cycle 142.

Figure 5:
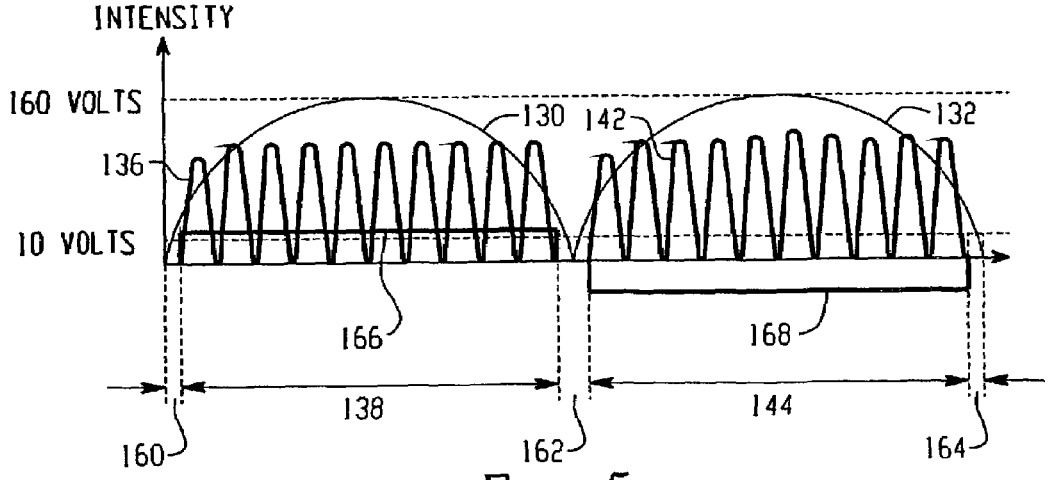

Turning to FIG. 5, reference numerals similar to those in FIG. 4 are used to show similarity, and newly numbered sections are used to emphasize distinctions.

Since lamp electronic circuit 44 of FIG. 3 does not use a voltage-breakover device for starting regenerative operation of its gate control circuitry, the circuit can start at a relatively lower d.c. bus voltage of, for instance, 10 volts. As shown in FIG. 5, this considerably reduces the time intervals 160, 162 and 164 during which averaged a.c. currents 166 and 168 are zero, directly resulting in a high power factor for a.c. current supplied by the a.c. source. Further, the averaged a.c. currents 166 and 168 are more centered in their respective half cycles; which increases power factor. An economical circuit can readily obtain a power factor of at least about 0.85, and, more preferably, at least about 0.9.

With a.c. current being much more continuously supplied to lamp electronics circuit 44, smoothing capacitor 48 of FIG. 3 needs to store a much reduced amount of energy compared to a typical lamp electronic circuit. As such, smoothing capacitor 48 is realized by a dry-type (i.e. non-electrolytic as defined above) capacitor having a much reduced value from a typical electrolytic capacitor. Since wearing out of an electrolytic capacitor is a typical limiting factor in a circuit of the type described herein, e.g., after 10,000 hours of use, replacing it with a dry-type capacitor substantially increases lifetime of the circuit. Additionally, the circuit can operate from very low d.c. voltages with its converter switches turning on and off with negligible voltage across them, i.e., with soft switching, to minimize deleterious switch heating.

Figure 6:
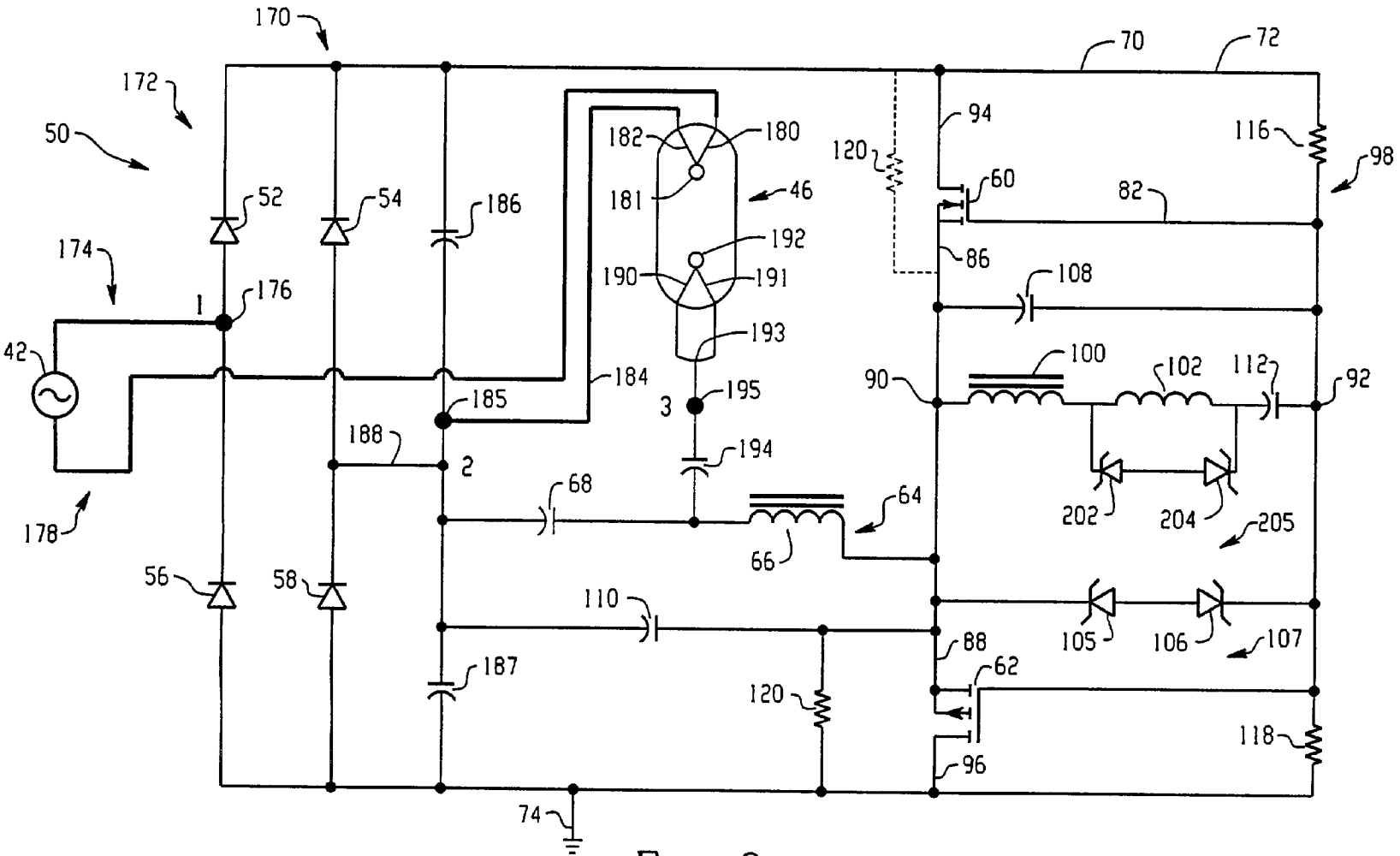
FIG. 6 depicts a circuit configuration according to the teachings of the present invention.

Turning to FIG. 6, depicted is a lamp lighting system 170 according to the teachings of the present invention. In this embodiment, components similar to those of FIG. 3 are provided with the same reference numerals. Due to the connection configuration of FIG. 3, when designed to fit within a lighting fixture, the connection points between the power source 42, lamp electronics 44 and lamp 46 result in the lamp electronics 44 and lamp 46 being distinct separate components.

FIG. 6, on the other hand, teaches a system 170, wherein lamp electronics 172 and lamp 46 are configured to permit lamp electronics 172 and lamp 46 to be formed as a single integrated unit. In this figure, power line connection 174 from power source 42 is used as a direct connection point to lamp electronics 172 at center point 176 (node 1) between diodes 52 and 56. Thus, power line 174 is placed directly between two diodes of full bridge rectifier 50. A second power line 178 from power source 42 is connected to a first end or terminal 180 of filament 181. The second end or terminal 182 of filament 181 is connected to connection wire 184 which is connected to center point 185 (node 2) between capacitors 186 and 187. Capacitors 186 and 187 are non-electrolytic or dry capacitors which are used for similar concepts but in a different manner than capacitor 48 of FIG. 3. This configuration results in the power source 42 being directly connected to the lamp electronics 172. A connection line 188 connects diodes 54, 58 of rectifier 50 to capacitors 186, 187.

Another or second side of lamp 46 has a first end or terminal 190 and a second end or terminal 191 of filament 192 shorted together by line 193. The shorted terminals are connected together at connection point 195 (node 3) to capacitor 194 . By this connection scheme terminals 190, 191 are connected to resonant inductor 66 and resonant capacitor 68, through capacitor 194. As an additional aspect or embodiment to the foregoing, terminals 180 and 182 may be shorted by optional line 196. The shorting of the terminals may be done to improve overall system efficiency by limiting cathode losses. The shorting of the terminals is preferably undertaken internally within an end cap holding the lamp electronics. Using this design, when the lamp unit is removed the connection is also removed from the system. The concept of incorporating the lamp electronics within an end cap will be discussed in greater detail in following sections of the discussion. From the foregoing it can be seen that the present embodiment teaches a three terminal (node) lamp network as opposed to prior art systems that employ a four terminal (node) network.

Figure 7:
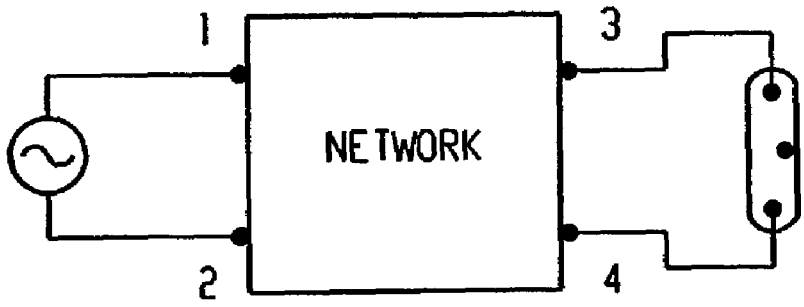
Fig. 7 PRIOR ART
FIG. 7 shows a block diagram of a four terminal (node) lamp connection configuration of the prior art.
Figure 8:
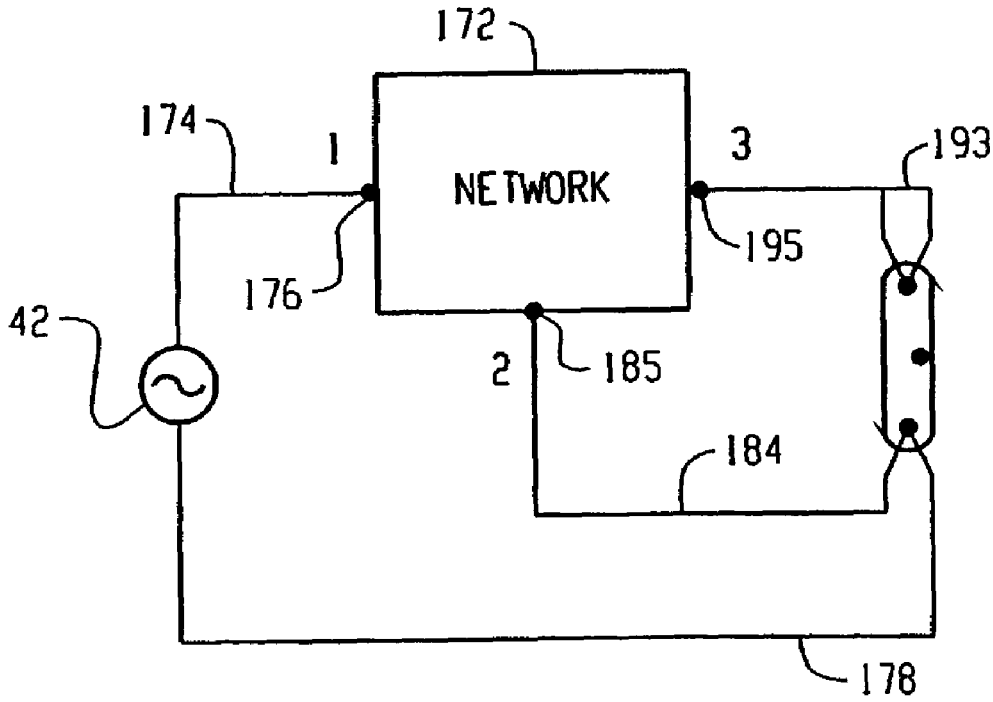
FIG. 8 illustrates a block diagram of a three terminal (node) lamp connection configuration achieved in accordance with the present invention.

In conventional lighting systems, terminal 182 would not be connected to terminal 185 (node 2). In other words, connecting line 184 would not exist. Further, line 178 would not connect terminal 180 to the power source 42. Rather, the power source would be directly connected to the rectifier 50. In existing instant start systems, terminals 180 and 182 may be connected together in order to short the cathode, and would be connected to an output within its lamp electronics. Therefore, and as can be seen more clearly in FIG. 7 (which represents block diagram of the wiring connections of FIG. 3), conventional lamp systems have two dedicated inputs (nodes 1, 2) and two dedicated outputs (nodes 3, 4). However, in the present embodiment, and as shown in the block diagram of FIG. 8, there is a single dedicated input (node 1), a dual-function input/output (node 2), and a single dedicated output (node 3). This connection scheme eliminates the need for a conductor to be provided along side or inside the length of the lamp. Rather, in the present embodiment the connecting wire to the opposite side of the lamp is run within the fixture. It is possible to run this wire within the fixture, and not directly connected to the lamp electronics since the connections are made to one side of the power line, e.g. line 178. The lamp electronics output and input are now one connection. This means that the pin which goes to the input of lamp power source 42 serves as an input and an output (line 178).

Use of the non-electrolytic capacitors 186 and 187 provides a high-power factor for starting of the linear lamp 46. Non-electrolytic capacitors 186 and 187, are low in value which is beneficial to providing a high power factor. However, due to their low value, they have a tendency to quickly enter a discharge state at times when they are not being charged. Diodes 54 and 58 prevent capacitors 186 and 187 from charging in the reverse directions.

Figure 9:
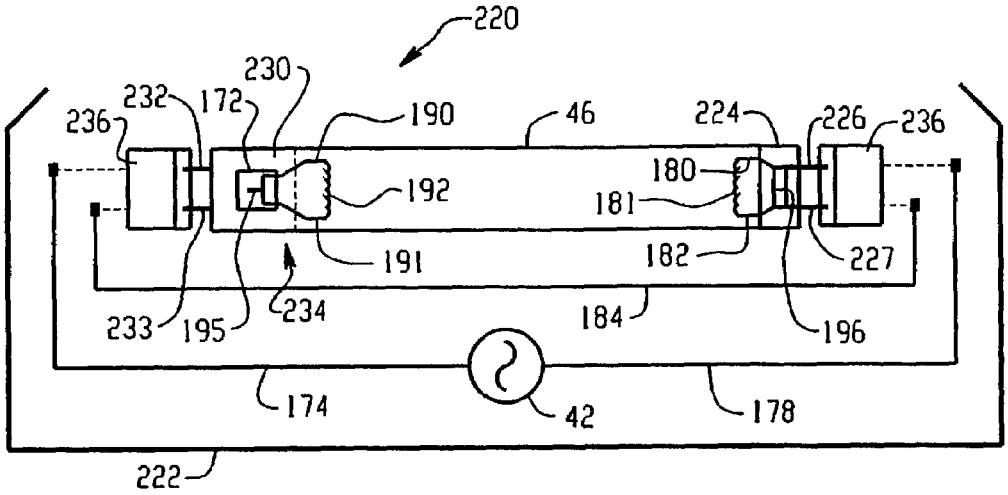
FIG. 9 depicts a circuit configuration of the present invention emphasizing the integral nature of the lamp electronics and lamp.

Diodes 202 and 204 are used as a voltage clamp 205, which limits the amplitude of the lamp voltage. Please refer to U.S. Pat. No. 6,078,143 for details. Turning attention to FIG. 9, depicted is lamp electronics 172 and linear fluorescent lamp 46 formed as a single lamp/lamp electronics unit 220, connected within lamp housing or fixture 222. An end cap 224 having pins 226, 227 is permanently connected to one end of lamp 46. This connection may be made by connecting electrical terminals 180, 182 to end cap 224. At the opposite end, lamp electronics end cap 230 is configured with an interior section to hold lamp electronics 172, and is connected to lamp 46 by terminals 190, 191. Lamp electronics end cap 230 also has pins or connectors 232, 233 extending from an outer surface. The lamp electronics cap 230 and lamp 46 are integrally connected at connection area 233. Pins or connectors 226, 227 and 232, 233 are respectively inserted within connectors 234, 236 in a manner known in the art. Such connectors may be tombstone connectors or other connectors well known in the art.

It is noted that lamp housing or fixture 222 may be a conventionally sized housing or fixture. Lamp/lamp electronics unit 220, can be designed to be of a size to fit into such existing housing or fixtures. For example lamp/lamp electronics unit 220, may be designed of a length equal to a T8, T16 or other known lamp size. It is further to be understood that the lamp electronics end cap 230 is formed and sized such that it replaces existing end caps, which would otherwise be attached in the manufacturing process As to be understood, in the present invention, the attachment of power lines 174, 178 and connection line 184 are made such that upon removal of unit 220, lines 174, 178 and 184 are maintained within the housing fixture 222. Thus, unit 220 can be removed alone without the need of also removing any one of the lines 174, 178, or 184.

Figure 10:
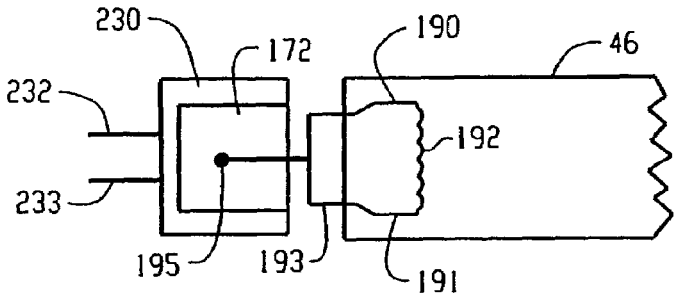
FIG. 10 depicts connection techniques for connecting the lamp electronics and lamp of the present invention.

FIG. 10 illustrates the physical integration between lamp electronics 172 and lamp 46 which may be accomplished through various connection techniques. In FIG. 10, ends or terminals 190 and 191 of shorted filament 192, are connected to capacitor connection 195 internally in lamp electronics 172. The connection between the lamp electronics 172 and terminals 190, 191 may be accomplished through many known connection techniques including soldering, welding, wrapping, or a mechanical locking mechanism, among others.

Figure 11:
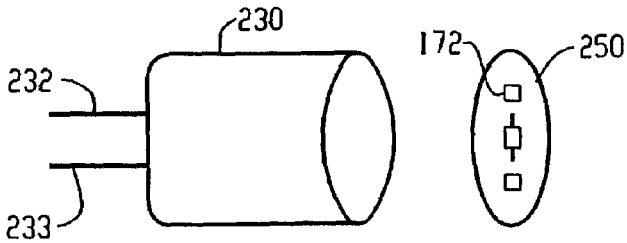
FIG. 11 illustrates the lamp electronics on a circuit board and lamp electronics cap.

Turning to FIG. 11, in one embodiment, lamp electronics 172 may be configured on a circuit board 250, but does not necessarily have to be mounted on a circuit board. This circuit board may be a single-sided or double-sided circuit board. The circuit board configuration may be substantially similar to the configuration of lamp electronics cap 230. The lamp electronics 172 carried on circuit board 250 is inserted within cap 230 and connections from lamp 46 will be made to the surface of the circuit board 250 at the appropriate locations. Pins 232 will also be appropriately connected to circuit board 250 such that appropriate connections with lines 174, 178 and 184 are made to lamp electronics 172. Therefore, cap 230 is sufficiently sized to receive the circuit board 250 within its interior in a secure relationship. The board itself may be fastened within cap 230 using known processes, such as using an adhesive, soldering or other known connection techniques. Cap 230, after appropriate connections have been made to board 250, will then be integrated to lamp 46, again using known sealant and/or connection techniques. It is to be appreciated that while this circuit board configuration is disclosed in this embodiment, other configurations that are not limited to circuit boards may also be used to achieve integrated lamp/lamp electronics unit 220.

Lamp/lamp electronics unit 220, allows a user to know that when a failure occurs it is the unit 220 as a whole which needs to be replaced. Previously, in existing three or four lamp systems, when a failure would occur a lamp change alone would be made and if the system still did not work, then it would be necessary to replace the electronics. Lamp/lamp electronics unit 220 eliminates this uncertainty. It also eliminates the requirement of an electrician being called to replace the electronics, since no wiring changes need to be made. Rather, unit 220 is simply removed, and a new unit 220 is inserted.

In existing lamp systems, a linear fluorescent lamp will commonly have a life expectancy significantly different from lamp electronics powering the lamp. Employing the present innovation, the life of the lamp electronics and life of the lamp are more closely matched.

Further, by providing the present lamp electronics with a specific individual lamp, the lamp electronics can be more finely tuned to the operational ranges of the specific lamp with which it is integrated. This situation allows for an improvement in efficiency of operation for the lamp electronics as it controls operation of the lamp.

A further aspect of the present invention is that lamp/lamp electronics unit 220 may be inserted into the lamp connectors 234, 236 in any fashion. More particularly, pins 232, 233 of lamp electronics end cap 230 may be inserted into either of lamp connectors 234, 236, as can pins 226, 227 of end cap 224. Thus it is not necessary to be concerned as to proper polarity of insertion of unit 220.

The present invention also does not require the use of a shutdown circuit for the removal of the lamp. Rather, as soon as the lamp/lamp electronics unit 220 is removed from the connections, power is removed from the circuit.

Returning attention to FIG. 9, it is noted that in this figure power source 42 is depicted as being internal to housing or fitting 222. It is understood that this is simply for sake of convenience and the actual power supply to such housings may be external such as from a home or office lighting system.

Exemplary component values for the circuit of FIG. 6 are as follows for a fluorescent lamp 46 rated at 16.5 watts, with a. bus voltage having an average value of approximately 107 volts:

| | |
|---|---|
| Diodes 52–58 | 1N4005 |
| Resonant inductor 66 | 280 μH |
| Resonant capacitor 68 | 4.7 nF |
| Driving inductor 100 | 2.2 μH |
| Turns ratio between 66 and 100 | about 12 |
| Second inductor 102 | 820 μH |
| Zener diodes 105, 106, (each) | 10 volts, 1N5240 |
| Capacitor 108 | 1 nF |
| Capacitor 110 | 680 pF |
| Capacitor 112 | 2.2 nF |
| Resistors 116, 118 and 120, each | 130 k ohm |
| Capacitor 194 | 22 nF |
| Smoothing capacitors (each) 186, 187 | 68 nF |
| Zener Diodes (each) 202, 204 | 51 Volt Zener diodes, 1N5262 |

Additionally, switch 60 may be an IRFR214, n-channel, enhancement mode MOSFET, sold by International Rectifier Company, of El Segundo, Calif.; and switch 62, an IRFR9214, P-channel, enhancement mode MOSFET also sold by International Rectifier Company.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. An integrated lamp/lamp electronics unit comprising:

a lamp having a first end with first end terminals, and a second end with second end terminals;

an end cap having an interior section, where the end cap is in electrical connection with the first end terminals at the first end of the lamp;

lamp electronics configured to control operation of the lamp, wherein as between the first end terminals and the second end terminals, the lamp electronics are connected only to the second end terminals; and a lamp electronics end cap having an interior sized to hold the lamp electronics therein, wherein connection between the lamp and the lamp electronics is by three node connections, a first node being used as a dedicated input, a second node being used as an input and output, and a third node being used as a dedicated output.

2. The lamp/lamp electronics unit according to claim 1 wherein the lamp electronics are carried on a circuit board or a fixture having a configuration substantially matching the second end of the lamp portion.

3. The lamp/lamp electronics unit according to claim 2 wherein the lamp electronics are carried on the circuit board.

4. The lamp/lamp electronics unit according to claim 1 wherein the dedicated output is an internal connection between the lamp and lamp electronics.

5. The lamp/lamp electronics unit according to claim 1 wherein the lamp is a linear fluorescent lamp.

6. A lamp system comprising:

a lamp having a first end with first end terminals, and a second end with second end terminals; and lamp electronics configured to control operation of the lamp, wherein as between the first end terminals and the second end terminals, the lamp electronics are connected only to the second end terminals, wherein connection between the lamp and the lamp electronics is by three node connections, a dedicated input node, an input and output node, and a dedicated output node.

7. The lamp system according to claim 6 further including a power supply for powering the system, and wherein the lamp electronics are connected to only one side of the power supply.

8. The lamp system according to claim 6 wherein the lamp electronics are carried on a fixture having a configuration substantially matching the second end of the lamp.

9. The lamp system according to claim 8 further including a lamp electronics end cap, having an interior sized to hold the lamp electronics carried on the fixture, wherein the lamp electronics carried on the fixture are located within the interior of the lamp electronics end cap.

10. The lamp system according to claim 6 wherein the dedicated output node is an internal connection between the lamp and lamp electronics.

* * * * *